US008699200B2

(12) United States Patent
Peczalski et al.

(10) Patent No.: US 8,699,200 B2
(45) **Date of Patent: *Apr. 15, 2014**

(54) SECURE NON-CONTACT SWITCH

(75) Inventors: Andy Peczalski, Eden Prairie, MN (US); Gangi Rajula, Andhrapradesh (IN)

(73) Assignee: Honeywell International Inc., Morristown, NJ (US)

( * ) Notice: Subject to any disclaimer, the term of this patent is extended or adjusted under 35 U.S.C. 154(b) by 869 days.

This patent is subject to a terminal disclaimer.

(21) Appl. No.: 12/871,809

(22) Filed: Aug. 30, 2010

(65) Prior Publication Data

US 2011/0193663 A1 Aug. 11, 2011

Related U.S. Application Data

(63) Continuation-in-part of application No. 12/701,497, filed on Feb. 5, 2010, now Pat. No. 8,456,792.

(51) Int. Cl.
*H01H 47/00* (2006.01)

(52) U.S. Cl.
USPC ..... 361/179

(58) Field of Classification Search
USPC ..... 361/179
See application file for complete search history.

(56) References Cited

U.S. PATENT DOCUMENTS 4,105,899 A 8/1978 Velosa
5,729,163 A * 3/1998 McCleary et al. ..... 327/104
5,757,672 A 5/1998 Hoepken
5,836,187 A 11/1998 Janssen et al.
6,072,383 A 6/2000 Gallagher, III et al.
6,212,052 B1 4/2001 Heuer et al.

(Continued)

FOREIGN PATENT DOCUMENTS

WO 0034605 6/2000
WO 2008041143 4/2008
WO 2008131704 11/2008

OTHER PUBLICATIONS

U.S. Appl. No. 12/701,497, filed Feb. 5, 2010.

(Continued)

*Primary Examiner* — Stephen W Jackson
(74) *Attorney, Agent, or Firm* — Seager Tufte & Wickem LLC.

(57) ABSTRACT

A redundant non-contact switch reports a status as closed or open for a first member and a second member that move relative to each other between an open state and a closed state. In some embodiments, the redundant non-contact switch includes a wireless authentication (WA) pair and a magnetic pair. The WA pair may include a WA responder attached to one of the first member and the second member, and a WA interrogator attached to the other of the first member and the second member. The WA pair may be configured to register a WA status of closed or open, depending on a WA authentication between the WA responder and the WA interrogator. The magnetic pair may include a magnet attached to one of the first member and the second member, and a magnet sensor attached to the other of the first member and the second member. The magnetic pair may be configured to register a magnetic status of closed or open, depending on whether a magnet distance between the magnet and magnet sensor is beyond a threshold magnet distance. In some instances, the redundant non-contact switch reports the status as closed only if both the WA status is registered as closed and the magnetic status is registered as closed.

20 Claims, 11 Drawing Sheets

(56) References Cited

U.S. PATENT DOCUMENTS

| | | | | |
|---|---|---|---|---|
| 6,283,514 | B1 | 9/2001 | Letzel | |
| 6,311,803 | B1 | 11/2001 | Turk | |
| 6,366,532 | B1 | 4/2002 | Hoepken | |
| 6,539,760 | B1 | 4/2003 | Letzel et al. | |
| 6,570,817 | B2 | 5/2003 | Hoepken | |
| 6,659,232 | B2 | 12/2003 | Oelschlegel | |
| 7,086,111 | B2 | 8/2006 | Hilscher et al. | |
| 7,357,429 | B2 | 4/2008 | Eichenauer | |
| 7,377,560 | B2 | 5/2008 | Wiemer et al. | |
| 7,469,838 | B2 | 12/2008 | Brooks et al. | |
| 7,474,111 | B2 | 1/2009 | Narita | |
| 7,492,905 | B2 | 2/2009 | Fitzgibbon | |
| 7,504,747 | B2 | 3/2009 | Pullmann et al. | |
| 7,520,426 | B2 | 4/2009 | Hoepken et al. | |
| 7,545,620 | B2 | 6/2009 | Klees | |
| 7,696,878 | B2 | 4/2010 | Cable et al. | |
| 8,008,909 | B2 * | 8/2011 | Feucht et al. | 324/207.12 |
| 2005/0108945 | A1 | 5/2005 | Wiemer et al. | |
| 2006/0220846 | A1 | 10/2006 | Stratmann | |
| 2006/0226948 | A1 | 10/2006 | Wright et al. | |
| 2007/0013236 | A1 | 1/2007 | Fleiner et al. | |
| 2007/0205861 | A1 | 9/2007 | Nair et al. | |
| 2008/0048826 | A1 | 2/2008 | Agrawal et al. | |
| 2009/0058607 | A1 | 3/2009 | Hou et al. | |
| 2010/0079289 | A1 | 4/2010 | Brandt et al. | |
| 2010/0097186 | A1 | 4/2010 | Wielebski et al. | |

OTHER PUBLICATIONS

Engineer Live, "Safety Switch Uses RFID Technology," 3 pages, Jul. 17, 2009.

Etta, "New Non-Contact Safety Interlocks Satisfy Safety Category 3 or 4 Requirements," 10 pages, prior to Feb. 5, 2010.

Euchner, "Non-Contact Safety Systems CES-A/CES-AZ," 11 pages, prior to Feb. 5, 2010.

Rockwell Automation Inc, "Integrated Saftey, Let the Ripple-Effect Increase Your Bottom Line," Brochure, 6 pages, 2008.

Rockwell Automation "Sensaguard RFID Coded Non-Contact Interlocks," 2 pages, Feb. 2008.

Schmersal Ltd., "RFID Key-Operated Selector Switch," 1 page, Apr. 14, 2008.

* cited by examiner

SECURE NON-CONTACT SWITCH

This application is a continuation-in-part of co-pending U.S. patent application Ser. No. 12/701,497, filed Feb. 5, 2010, and entitled "SECURE NON-CONTACT SWITCH", which is incorporated herein by reference.

TECHNICAL FIELD

The disclosure relates generally to switches, and more particular to non-contact type switches.

BACKGROUND

Non-contact type switches are commonly used in a wide variety of applications. For example, non-contact type switches are commonly used in interlock systems that restrict access to certain areas or equipment. For example, in an industrial setting, a potentially hazardous robot may be surrounded by a barrier that has an entrance gate. The gate may be equipped with a non-contact type switch whose state depends on whether the gate is open or closed. If the non-contact type switch indicates an open gate, a controller may command the robot to enter a safe state, such as a non-moving state.

In some instances, non-contact type switches may be willfully defeated in order to bypass certain safety or other features provided by the non-contact type switches. For example, if a non-contact type switch on one side of a gate is operated by a magnetic relay, the operator may permanently attach a magnet to the relay, thereby permanently closing the relay even when the gate is opened. What would be desirable, therefore, is a more secure non-contact type switch that would be more difficult to defeat. Such a non-contact type switch would have a wide variety of applications, including many interlock applications.

SUMMARY

The disclosure relates generally to switches, and more particular to non-contact type switches. In an illustrative but non-limiting example, the disclosure provides a redundant non-contact switch for reporting, for example, a status of closed or open for a first member and a second member that move relative to each other between an open state and a closed state. An illustrative redundant non-contact switch may include a wireless authentication (WA) pair and a magnetic pair. The WA pair may include a WA responder attached to one of the first member and the second member, and a WA interrogator attached to the other of the first member and the second member. The WA pair is configured to register a WA status of closed or open, depending on a WA authentication between the WA responder and the WA interrogator. The magnetic pair may include a magnet attached to one of the first member and the second member, and a magnet sensor attached to the other of the first member and the second member. The magnetic pair may be configured to register a magnetic status of closed or open, depending on whether a magnet distance between the magnet and magnet sensor is beyond a threshold magnet distance. In some instances, the redundant non-contact switch may be configured to report the status as closed only if both the WA status is registered as closed and the magnetic status is registered as closed.

In some instances, operation of the WA authentication and/or the magnetic pair relies on inductive power transmission. In one example, a transmit coil may be attached to one of the first member and the second member, and a receive coil may be attached to the other of the first member and the second member. When so provided, sufficient operational power may only be provided for the WA authentication and/or the magnetic pair when the distance between the transmit coil and the receive coil is within a threshold distance.

The above summary is not intended to describe each and every disclosed illustrative example or every implementation of the disclosure. The Description that follows more particularly exemplifies various illustrative embodiments.

BRIEF DESCRIPTION OF THE FIGURES

The following description should be read with reference to the drawings. The drawings, which are not necessarily to scale, depict selected illustrative embodiments and are not intended to limit the scope of the disclosure. The disclosure may be more completely understood in consideration of the following detailed description of various illustrative embodiments in connection with the accompanying drawings, in which.

DESCRIPTION

The following description should be read with reference to the drawings, in which like elements in different drawings are numbered in like fashion. The drawings, which are not necessarily to scale, depict selected illustrative embodiments and are not intended to limit the scope of the disclosure. Although examples of construction, dimensions, and materials are illustrated for the various elements, those skilled in the art will recognize that many of the examples provided have suitable alternatives that may be utilized.

Figure 1:
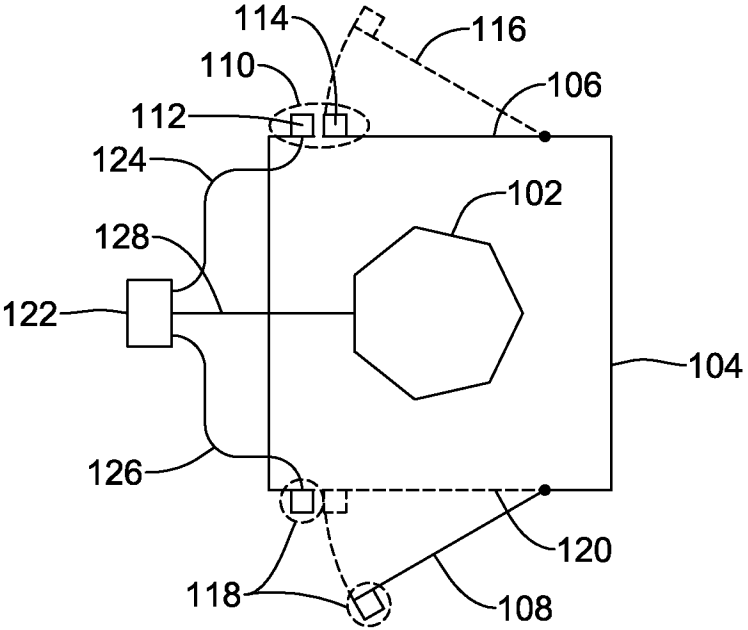
FIG. 1 is a schematic plan view of a machine, device, or item protected by an illustrative interlock system.

FIG. 1 is a schematic plan view of a machine, device, or item 102 protected by an illustrative interlock system. Machine, device, or item 102 may be any suitable item for which it may be desired to provide protection with an interlock system, such as the interlock system shown in FIG. 1.

Device 102 is disposed within a barrier 104, which has a first door 106 and a second door 108. First door 106 is equipped with a non-contact switch 110 having a first part 112 and a second part 114. First door 106 is illustrated in a closed position, with a phantom representation 116 showing the first door in an open position. Second door 108 is also equipped with a non-contact switch 118 and is shown in an open position, with a phantom representation 120 showing the second door in a closed position. First and second non-contact switches 110, 118 are connected to an interlock system controller 122 via communication links 124, 126, which may use any suitable communication method, such as hard wired, optical, radio, and the like. In some embodiments, the interlock system controller 122 may be a muting safety controller, and the communication links 124, 126 may be provided by conventional 24 Volt power supply and signal channel cabling, or use Ethernet, RF (Radio Frequency), IR (Infra-Red), optical, or any other communication technique or method as desired. The communication links 124, 126 provide a way for first and second non-contact switches 110, 118 to communicate their current status such as 'open' or 'closed' to the interlock system controller 122. In the example shown, the interlock system controller 122 is also connected by a communication link 128 to machine 102, so that it may, for example, communicate an unsafe or open condition to the machine, which may shut down, enter a safe condition, or take any other appropriate action as desired.

FIG. 1 shows an illustrative interlock system installation. In some other illustrative embodiments, fewer or greater than two doors may be employed in such a system. The interlock system may be configured with any other suitable components, such as stop, trip and/or enabling switches, interlock keys, presence sensing devices, and so on. Machine, device, or item 102 may be any one or multiple object(s) for which interlock system protection is desired, or may not necessarily be present or disposed in barrier 104 at all; the interlock system may protect a region of space, or those entering a space, or may be used in any other suitable manner, as desired.

Figure 2A:
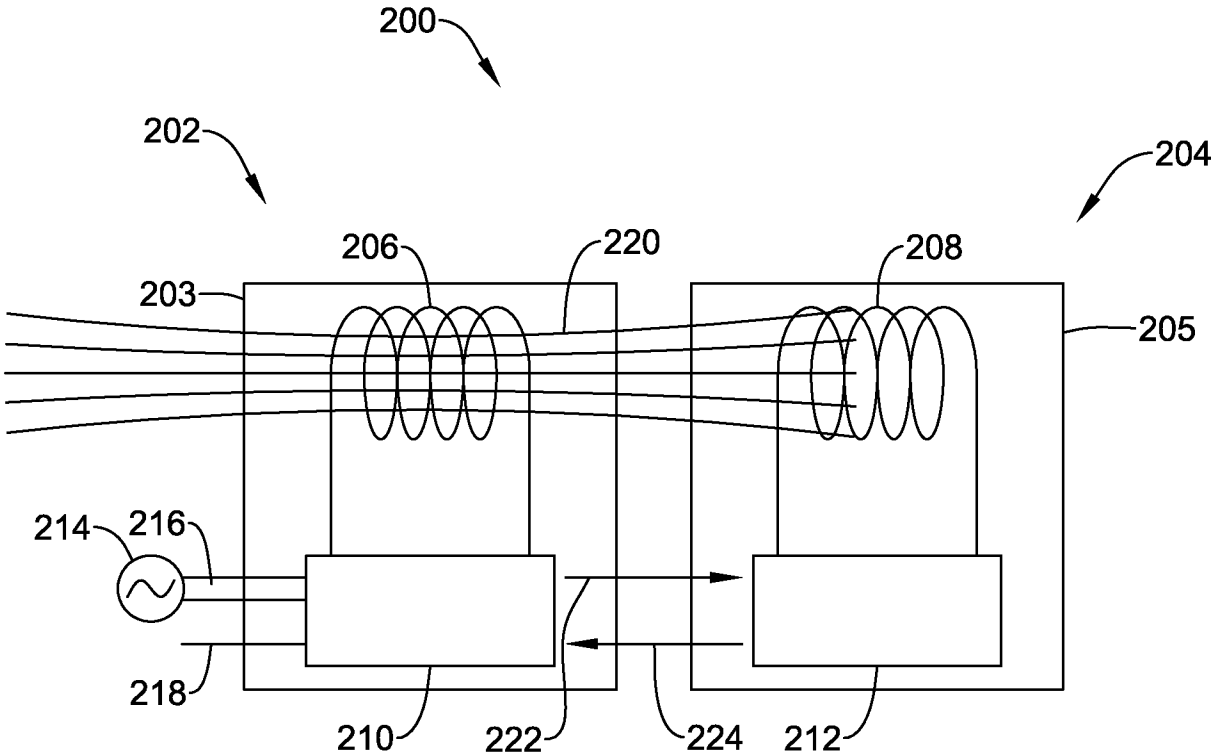
FIG. 2*a* is a schematic diagram of an illustrative non-contact switch having first and second parts in close proximity within a threshold distance of each other.
Figure 2B:
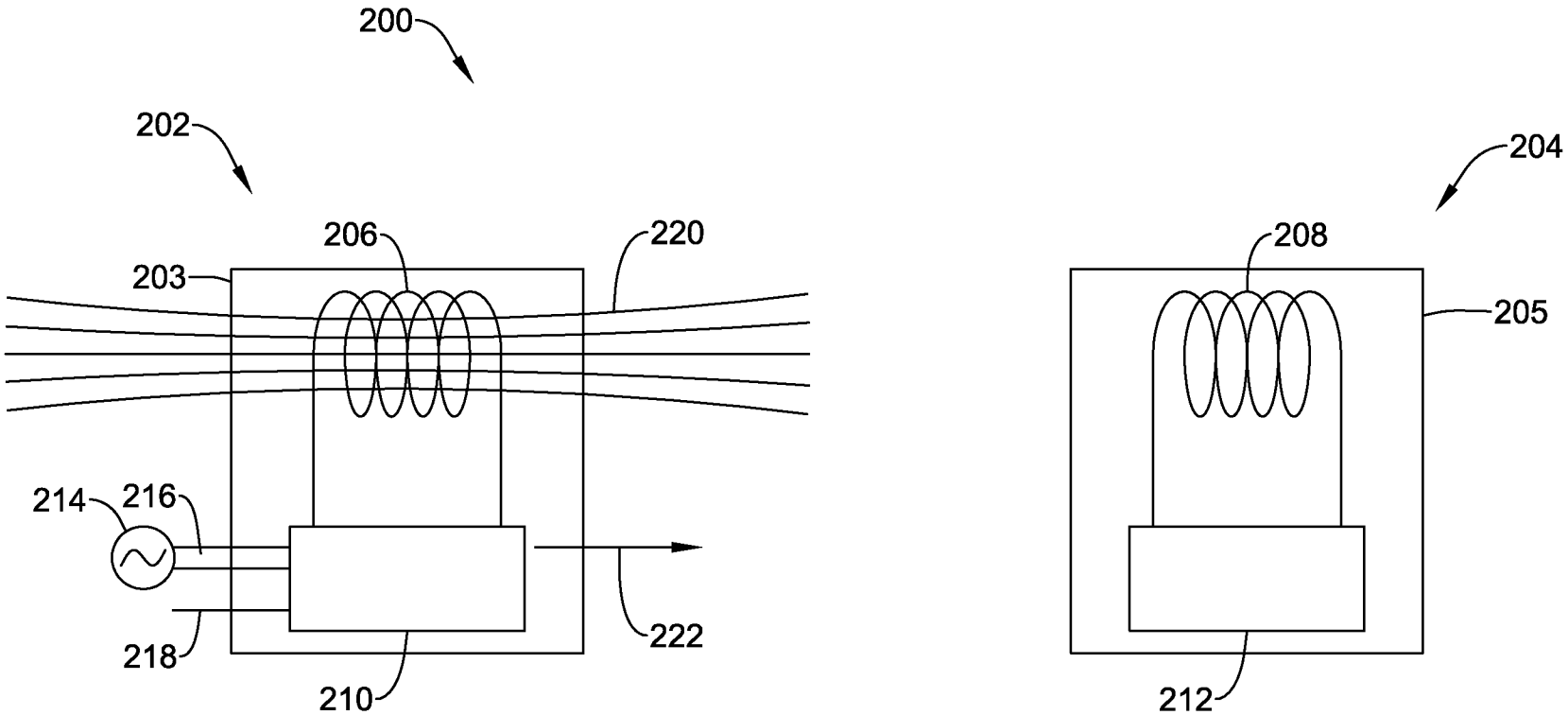
FIG. 2*b* is a schematic diagram of the illustrative non-contact switch of FIG. 2*a*, showing the first and second parts separated by more than a threshold distance.

FIGS. 2*a* and 2*b* are schematic diagrams of an illustrative non-contact switch 200, and in some instances may be used as either of switches 110 or 118 in the illustrative interlock system of FIG. 1 as one example. Components of the illustrative non-contact switch 200 are generally divided between a first part 202 and a second part 204. Components of each part may be housed in a common enclosure, such as first enclosure 203 and second enclosure 205, as shown in the illustration, but this is not required. Generally, first part 202 (i.e., the collection of components of switch 200 belonging to the first part) is mounted, attached, or otherwise disposed on a first member or structure (not shown), and second part 204 is mounted, attached, or otherwise disposed on a second member or structure (not shown), where the first and second members may move relative to each other between an open state and a closed state. For example, second part 204 may be mounted on a door stile, such as first door 106 of FIG. 1, and first part 202 may be mounted on a door jamb. When so provided, when the door is closed, components of the first and second parts are brought into close proximity (e.g. within a threshold distance), and when the door is open, components of the first and second parts are separated by some distance (e.g. greater than a threshold distance).

FIG. 2*a* illustrates the first and second parts 202, 204 of the illustrative non-contact switch 200 in close proximity, as may be the case when a door with which the switch is associated is closed. FIG. 2*b* illustrates first and second parts 202, 204 of non-contact switch 200 separated by a greater distance as compared to FIG. 2*a*, as may be the case when a door with which the switch is associated is open. While FIG. 2*b* shows the first part 202 and the second part 204 separated left-to-right, relative to the figure, the first and second parts may be separated in other directions as well, such as up-down, or along an arbitrary axis. First and second parts 202, 204 may be rotated relative to each other as the first and second members to which they are respectively attached move relative to each other.

Non-contact switch 200 of FIG. 2 may be structured and configured so that it reports a status of closed only if first part 202 and second part 204 are disposed or positioned relative to each other appropriately, as discussed further herein. Being disposed relative to each other appropriately may include being separated by or within (e.g. less than) an appropriate displacement and/or distance, and/or may include being oriented with an appropriate rotational attitude with respect to each other. These displacement, distance, and/or attitude/orientation characteristics may apply to any non-contact switch of the present disclosure, and physical means for achieving switch functionality based upon such characteristics are further described herein.

The illustrative non-contact switch 200 may also be structured and configured such that it reports a status of closed only if a wireless authentication (WA) is successfully achieved between the first part 202 and the second part 204, in which a WA responder component of the second part properly identifies itself to a WA interrogator component of the first part. This wireless authentication functionality may apply to any non-contact switch of the present disclosure. Various implementations of wireless authentication are further described herein.

The illustrative non-contact switch 200 of FIGS. 2*a* and 2*b* may include an inductive power transmission pair including an inductive power transmit coil 206 and an inductive power receive coil 208. The inductive power transmission pair may employ a 40 mA square waveform for power transfer, but this is only illustrative. The illustrative non-contact switch 200 of FIGS. 2*a* and 2*b* may also include a wireless authentication pair including a WA interrogator 210 and a WA responder 212. Inductive power transmit coil 206 and inductive power receive coil 208 may also serve as antennas for WA interrogator 210 and WA responder 212 respectively, although this is not required. In some illustrative embodiments, either or both of WA interrogator 210 and WA responder 212 may have an antenna or antennas distinct from the inductive power coils 206, 208, or they may not employ distinct antennas. In some instances, WA interrogator 210 and WA responder 212 may include antennas that replace inductive power coils 206, 208, such as when WA interrogator 210 and/or WA responder 212 are implemented using, for example, a Surface Acoustical Wave (SAW) device that is powered through an antenna and produces a corresponding ID signal using the same or a different antenna.

As illustrated in FIGS. 2*a* and 2*b*, inductive power transmit coil 206 is connected to a power supply 214 via power lines 216, sometimes through WA interrogator 210, although this is not required. With power lines 216 passing through the WA interrogator 210, the interrogator may be said to provide power to the inductive power transmit coil 206, and if sufficiently close, to the WA responder 212. In some illustrative embodiments, inductive power transmit coil 206 may be connected to power supply 214 independently of WA interrogator 210, which may receive power from the same power supply through a separate connection, or from a different power supply (not shown). In FIGS. 2*a* and 2*b*, power supply 214 is illustrated as being external to enclosure 203 housing components of first part 202, but this is not necessary. In some illustrative embodiments, an enclosure for a first part of a non-contact switch may house an internal power supply, such as a battery.

In FIGS. 2*a* and 2*b*, first part 202 of non-contact switch 200 is attached to a cable 218 that may provide a communication link to an interlock system controller (not shown) or some other system, although this is not necessary. Cable 218 may be electrical or optical or may employ any suitable communication technology. In some illustrative embodiments, a communication link may be provided without a physical cable, such as through radio, optical, or any other appropriate technology. In some illustrative embodiments where a physical cable such as cable 218 is used, the cable may share a common physical path with power lines such as power lines 216. In some illustrative embodiments, communication cables and power lines may be combined, such that power and information may travel over the same conductors.

Inductive power receive coil 208 may be configured to provide operational power to WA responder 212, which in some instances, may require operational power from the inductive power receive coil to operate. Inductive power transmit coil 206 and inductive power receive coil 208 may be configured so that the inductive power receive coil 208 receives sufficient operational power to operate the WA responder 212 only when the inductive power coils 206, 208 are positioned proximally with respect to each other within a limited range of displacement (e.g. less than a threshold distance) and/or mutual orientation. These positioning criteria for the inductive power coils 206, 208 to transfer operational power may be effectively the same condition discussed herein where non-contact switch 200 reports a status of closed only if first part 202 and second part 204 are disposed relative to each other appropriately.

The positioning criteria for inductive power transfer arise at least in part from the fundamental physical phenomenon of Faraday induction upon which the power transfer is based. When inductive power transmit coil 206 carries a time-varying current, it produces a time-varying magnetic field, illustrated schematically with flux lines 220. The varying magnetic flux through receive coil 208, and hence the induced voltage/current in the coil, depends in part upon the relative positioning of the power transmit coil 206 and the power receive coil (e.g. separation distance or misalignment offset). As the relative displacement and/or orientation of the coils 206, 208 change, the power induced in the induced power receive coil changes. This may account for whether the WA responder 212 receives sufficient operational power to operate the WA responder.

In FIG. 2*a*, the inductive power coils 206, 208 of the inductive power transmission pair are shown in close proximity (less than a threshold distance), such that a significant magnetic flux from the transmission coil 206 is captured by the receive coil 208, resulting in transfer of sufficient operational power to the WA responder 212. In FIG. 2*b*, the inductive power coils 206, 208 of the inductive power transmission pair are shown separated by a considerable displacement (e.g. greater than a threshold distance), such that insufficient magnetic flux from the transmission coil 206 is captured by the receive coil 208 to result in transfer of sufficient operational power to the WA responder 212.

In some illustrative embodiments, additional circuitry (not shown) may be provided in the second part 204 of the non-contact switch 200. Such circuitry may, for example, analyze the electrical signal induced in the inductive power receive coil 208 to discern whether the transmit 206 and receive coils are positioned with respect to each other appropriately to satisfy the closed condition. Any suitable aspect of the electrical signal may be considered in such an analysis. For example, the voltage induced in the inductive power receive coil 208 may be compared with a preset threshold voltage or range of voltage. If the transmit 206 and receive 208 coils satisfy the closed condition, the additional circuitry may allow operational power to pass to the WA responder 212. If they do not, the additional circuitry may prevent operational power from passing to the WA responder 212. In some illustrative embodiments, additional circuitry may analyze whether the transmit 206 and receive 208 coils are positioned relative to each other appropriately to satisfy the closed condition, then accordingly register a "closed" or "open" status for the inductive power transmission pair to the WA responder 212 (or any other suitable non-contact switch component) without affecting provision of power to the WA responder 212. In some illustrative embodiments, functionality such as analysis of transmit 206 and receive 208 coil performance/positioning/etc. may be provided by WA responder 212.

In some illustrative embodiments, operational power is received by an inductive power receive coil 208 from an inductive power transmit coil 206 only when the coils are positioned within a threshold distance of each other. This condition may essentially be equivalent, in some embodiments, to the WA distance between the WA interrogator and responder being below a threshold WA distance. These threshold distances may be, for example, about 10 mm. In some illustrative embodiments, operational power is received by an inductive power receive coil 208 from an inductive power transmit coil 206 only when the coils are positioned within a pre-defined range of displacement, and within a pre-defined range of rotational orientation, with respect to each other.

In some illustrative embodiments, a local backup power supply (not show in FIG. 2) may be provided for either or both of the first part 202 and/or the second part 204. For example, one or more batteries, capacitors, "super" capacitors, or any other suitable energy storage device(s) may be used for such a purpose. A local backup power supply may be charged from a nominal power supply (e.g., from power supply 214 for the first part 202, and from inductive power receive coil 208 for the second part). With a backup power supply provided for the second part 204, WA responder 212 may operate for a period of time even if insufficient operational power is provided from receive coil 208. In such a situation, WA responder 212 may be configured to analyze the performance of the inductive power coils 206, 208 and communicate findings, for example, to the WA interrogator 210 and/or directly to the system controller before the backup power supply becomes depleted. Such communication may, for example, alert the system controller of unsatisfactory inductive power transfer such that the power transfer situation may be addressed.

The wireless authentication pair including WA interrogator 210 and a WA responder 212 may employ any suitable communication method, such as but not limited to, radio, acoustic, and optical, and any suitable protocol, including but not limited to RFID protocols, Wi-Fi (including IEEE 802.11 and related standards), ZigBee (including IEEE 802.15.4 and related standards), and so on. To perform a wireless authentication, WA interrogator 210 may broadcast an interrogation signal 222, schematically represented with an arrow directed toward WA responder 212. In some cases, WA interrogator 210 may employ inductive power transmit coil 206 as an antenna. In some embodiments, the interrogation signal 222 may be encoded upon the time-varying magnetic flux used to transfer power to inductive power receive coil 208. Inductive power receive coil 208, in turn, may be employed by WA responder 212 as an antenna. Upon receiving an interrogation signal 222 from the WA interrogator 210, and when sufficiently supplied with operational power, WA responder 212 may reply with a response signal 224, schematically represented with an arrow directed toward the WA interrogator in FIG. 2*a*. (In FIG. 2*b*, the WA responder 212 does not respond as it is not provided with sufficient operational power, or it may not respond because it has received an indication that the non-contact switch is not closed). Response signal 224 may be an authenticating response including an identification code such that WA interrogator 210 may determine whether the response signal matches a known identification code, and hence, matches an expected authenticating response. A WA interrogator 210 may be configured to register a WA status of closed only if such a successful authenticating match is made, and to register a WA status of open otherwise. A WA interrogator 210 or responder 212 may register or report a status of "attempt to defeat" for unsuccessful authentication attempts. For switch 210, WA status of closed or open may coincide with a switch status of closed or open. In some instances, the WA interrogator 210 may communicate a status of closed or open to an interlock system controller through a communication link, such as one using cable 218. In some embodiments of interlock systems, authentication/identifications codes may be managed such that each interlock switch employs one or more essentially unique codes, such that interrogators and responders of WA pairs essentially uniquely matched.

In some illustrative embodiments, "rolling" or "hopping" systems for varying codes may be employed.

In some illustrative embodiments, for additional security a WA interrogator as well as a WA responder may broadcast an identification code, and the WA responder may be configured to broadcast its authenticating response only if it receives a known identification code from the interrogator. Such secure authenticating procedures may be employed to make it more difficult to willfully bypass the switch.

In some illustrative embodiments, it may be desired to provide a switch bypass or override capability. In such cases, a third wireless transceiver, in addition to the interrogator and responder of a WA pair, may be used in a disarming key and brought into proximity of the interrogator. A disarming key may include other components as well, such as a magnetic component to serve as part of a magnetic pair. The third wireless transceiver may mimic the nominal WA responder, or it may broadcast its own distinct identification code that the WA interrogator may be programmed to accept as a known bypass identification code. Such a switch bypass capability may provide multiple advantages over older switch technologies. For example, a bypass disarming key having a distinctive bypass identification code may make it possible for an interlock system controller to be aware that a bypass disarming key is in use, instead of the nominal second part corresponding to the first part of the switch. The controller and/or switch may, for example, log the information for later review, and/or the controller may take or command actions in view of the use of the bypass disarming key, such as issuing warnings or limiting machine operations. In some illustrative embodiments, any appropriate information about any attempted status changes of a non-contact switch may be logged, such as status changes (closed to open, open to closed), authentication attempts, missed authentication ("attempt to defeat") events, the success or failure of authentication attempts, the time of attempts, identification codes received, whether a bypass disarming key was used, power down events, failure to establish wireless links, other system health related events and information, etc. Logged information may be read out in any appropriate way, such as over cable 218 or any optical, wired, or wireless communication link.

In some instances, WA transceivers may be supplied by a manufacturer with pre-programmed identification codes (RFID tags with pre-programmed codes, SAW sensors with pre-programmed codes, etc.). In other instances, WA transceivers may be supplied in a field-programmable form. It may be possible to program WA pairs via, for example, an interlock system controller such as controller 122 of FIG. 1, or via additional or other hardware if desired. In some embodiments, a field programming device for WA transceivers may be used as a bypass disarming key or device, if desired.

In some embodiments, the WA transceivers may each include a microprocessor that may help combine wireless communication capabilities with additional functions. Such functions may include diagnostic capabilities. For example, a WA transceiver may include a microprocessor that can be configured to assess health (i.e., ability to function), the health of its WA partner, the quality of the communication link with its WA partner, the status of its power supply, etc. Measures relating to the performance of the non-contact switch from such assessments may be communicated to the system controller. WA transceiver microprocessors may further be configured to perform functions related to the magnetic sensors, such as analyzing signals from magnetic sensors and determining whether a magnetic/magnetic sensor pair should be registered as open or closed, as further discussed herein.

Figure 3A:
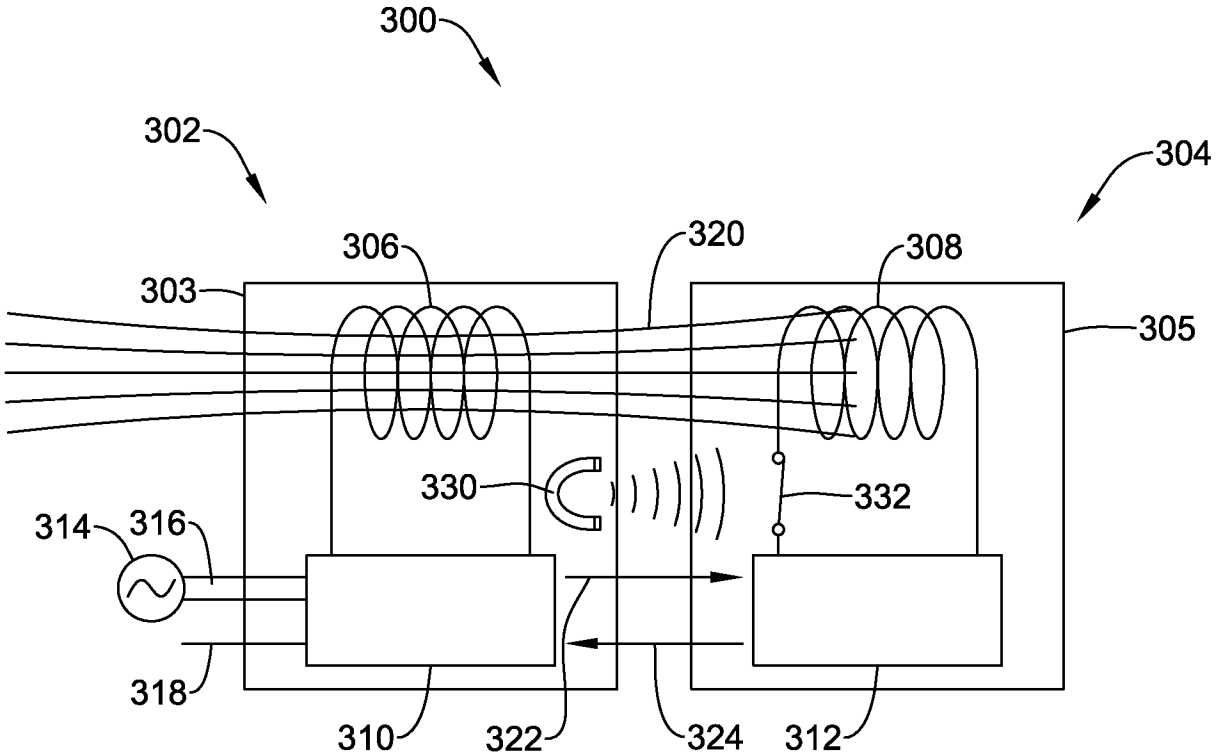
FIG. 3*a* is a schematic diagram of an illustrative non-contact switch with a magnet pair having first and second parts in close proximity within a threshold distance.
Figure 3B:
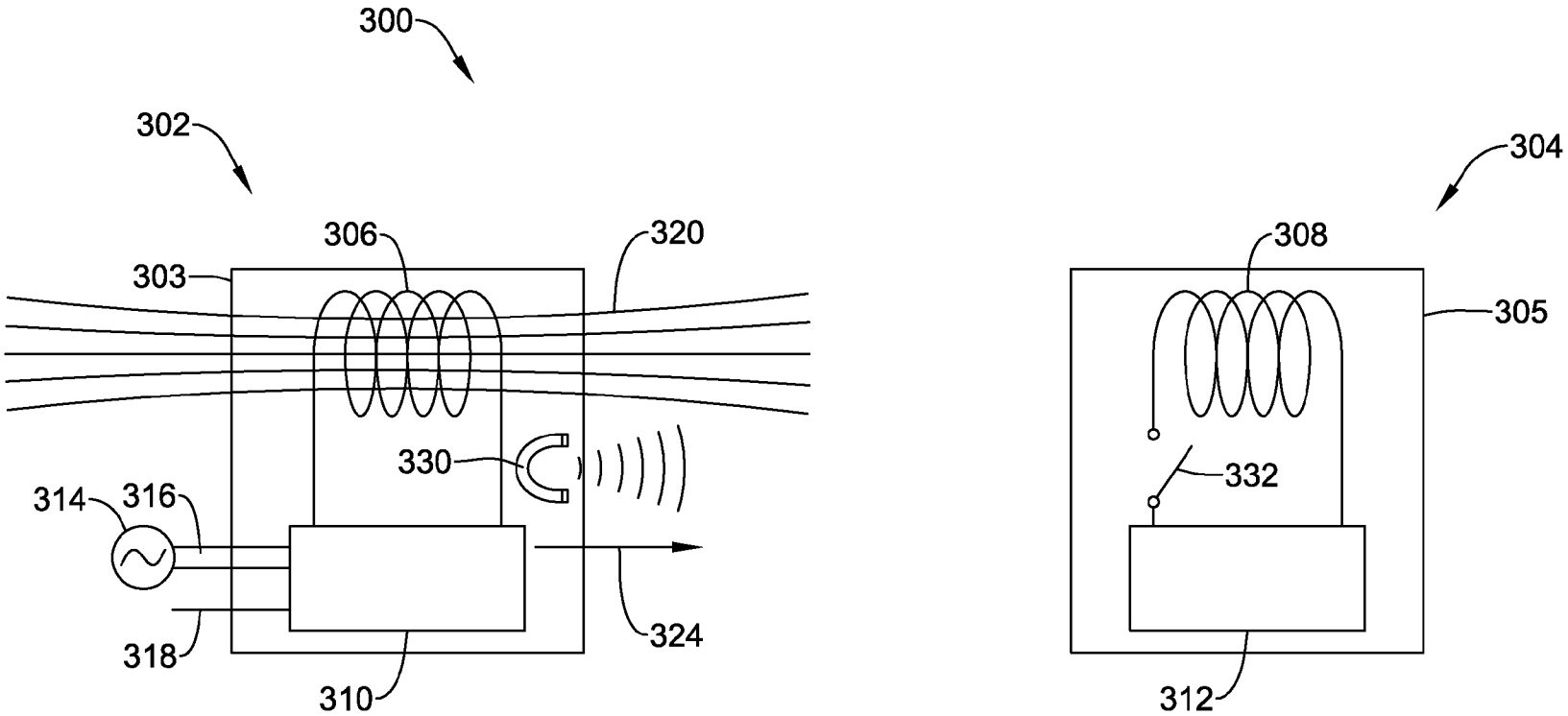
FIG. 3*b* is a schematic diagram of the illustrative non-contact switch of FIG. 3*a*, showing the first and second parts separated by more than a threshold distance.

FIGS. 3*a* and 3*b* are schematic diagrams of an illustrative non-contact switch 300, and in some instances may be used as either of switches 110 or 118 in the illustrative interlock system of FIG. 1 as one example. The components of switch 300 may be structured and configured with features of switch 200 of FIGS. 2*a* and 2*b*, or any features described in other illustrative embodiments of switches of the present disclosure, to the extent that they are compatible with the implementation in switch 300 of a magnetic pair. In the illustrative embodiment, the magnetic pair of switch 300 may include a magnet 330 and a magnet sensor 332. The magnetic pair may be configured to register a magnetic status of open or closed depending on the displacement and/or orientation of the magnet 330 relative to the magnet sensor 332. In some illustrative embodiments, the magnetic pair may be configured to register a magnetic status of closed or open, depending on whether a magnet distance between the magnet and magnet sensor is beyond a threshold magnet distance. If the magnet distance is beyond a threshold magnet distance, the magnetic pair may register a magnetic status of open, and if the magnet distance is within a threshold magnet distance, the magnetic pair may register a magnetic status of closed. In some illustrative embodiments, the magnetic pair may be configured to register a magnetic status of closed if the displacement between the magnet and magnet sensor is within a pre-determined range.

The magnetic pair of switches 300 of FIGS. 3*a* and 3*b* may be based upon any suitable magnetic technology. Magnetic sensor 332 may be any suitable magnetic sensor, such as a simple mechanical magnetic switch (e.g., a magnetic reed switch), a magnetic relay switch and/or another other suitable magnetic sensor. In some instances, the magnetic sensor may be based upon physical phenomena such as magneto-resistance, the Hall effect, and so on. Magnetic sensors without macroscopically moving parts may be considered non-mechanical magnetic sensors. Sensors based upon anisotropic magneto-resistance (AMR), giant magneto-resistance (GMR), and/or tunneling magneto-resistance (TMR) may be used. In some cases, a magnetic flux gate may be used as a magnetic sensor. Magnetic sensors based upon one or more of these non-mechanical magnetic sensors may be more sensitive than comparative mechanical magnetic switches, in an absolute sense and/or with regard to the resolution with which magnetic field may be detected/measured. Magnetic sensors based upon one or more of these non-mechanical magnetic sensors may allow considerable freedom in defining ranges of relative displacement and/or orientation between magnet and magnetic sensor pairs that may help define when a magnetic status is closed or open, in comparison with mechanical magnetic switches (e.g. magnetic reed switches). In some cases, magnetic sensors based upon one or more of these non-mechanical magnetic sensors may be sensitive in two or three spatial dimensions, which may allow greater freedom in magnet/sensor placement/orientation, when compared to one-dimensionally sensitive magnetic switches/sensors. The potentially greater freedom of magnet/sensor positioning may be of value, for example, in switches intended for high vibration environments where the separation/alignment between magnet and sensor pairs may vary during a period of vibration and/or build up over a period of time as a consequence of vibration and other mechanical stresses.

In some illustrative embodiments, magnetic pairs may be capable of registering magnetic status of closed with offset distances between a magnet and a corresponding magnetic sensor of greater than 7 mm, 8 mm, 9 mm, 10 mm, 12 mm, 15 mm, or more, as desired.

A magnetic pair may include associated electronic components, for example, for assessing the open or closed status of the pair. Other components of an interlock switch, such as WA transceiver microprocessors, may be configured to perform such functions as well as or in place of components dedicated to the particular magnetic pair. Any component of an interlock switch that is involved in the operation of the magnetic pair may be considered part of the magnetic pair, regardless of whether the component may be considered part of another system or sub-system of the interlock switch, such as a WA pair. In some illustrative embodiments, and as discussed further herein, one or more coils used for inductive power transfer may also be configured as part of a magnetic flux sensor of a magnetic pair. Sharing of a component between multiple systems of a non-contact switch may allow reductions in part count and system cost.

Magnetic sensors may be used in conjunction with electronic switches (for example, but not limited to, field-effect transistor power switches) to provide magnetically-actuated switching of current, or a signal that causes switching of current. This may be used in interlock switches for use in interlock system architectures in which conduction or non-conduction of current by an interlock switch may be used to indicate or determine an opened or closed status of the magnetic pair.

In FIGS. 3*a* and 3*b*, magnetic sensor 332 is schematically illustrated as a magnetically-actuated switch that closes (conducts) when first part 302 and second part 304 of switch 300 are disposed within a threshold magnet distance (FIG. 3*a*), and opens (does not conduct) when the parts are separated by more than the threshold magnet distance (FIG. 3*b*). In the illustrative embodiment shown in FIGS. 3*a* and 3*b*, magnetic sensor/switch 332 is schematically shown as being electrically connected between inductive power receive coil 308 and WA responder 312. Arranged thusly, magnetic sensor/switch 332 may allow (when closed) or prevent (when open) reception of an interrogation signal 322 by the WA responder 312, by connecting or disconnecting the WA responder 312 from the inductive power receive coil/antenna 308. That is, when the magnetic sensor/switch 332 is open, power may not be delivered to the WA responder 312.

In some illustrative embodiments, a magnetic sensor/switch may not physically make or break an electrical connection between a coil/antenna and responder, but may provide a signal of magnetic status (closed or open), and the responder, for example, may be configured to then accept or ignore input from the coil/antenna. For example, in some illustrative embodiments, the sub-systems of a non-contact switch (e.g., magnetic pair, WA pair, power transfer coils, etc.) may be allowed to perform or attempt to perform their respective functions, and a microprocessor (for example, incorporated with a WA radio transceiver) may make a determination based upon performance of the sub-systems as to whether the non-contact switch should be registered/reported as closed or open. Regardless of the particular implementation details, and in some instances, switch 300 may be configured so that it reports the status as closed only if both the WA status is registered as closed and the magnetic status is registered as closed. Note that as the positions of the first and second parts 302, 304 of switch 300 change with respect to each other, as would happen, for example, when the first and second parts move along with first and second members to which they are attached, the WA distance and magnet distance vary.

Figure 4A:
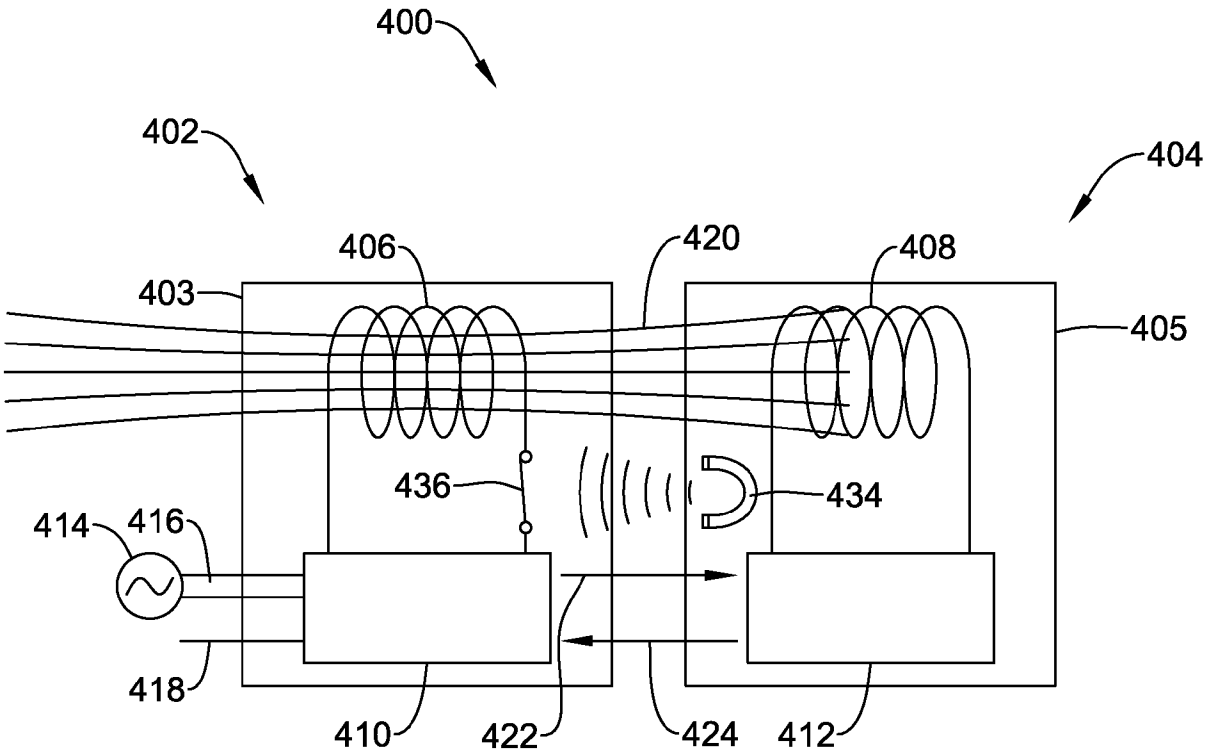
FIG. 4*a* is a schematic diagram of an illustrative non-contact switch having first and second parts in close proximity, with a magnet pair in an alternate arrangement.
Figure 4B:
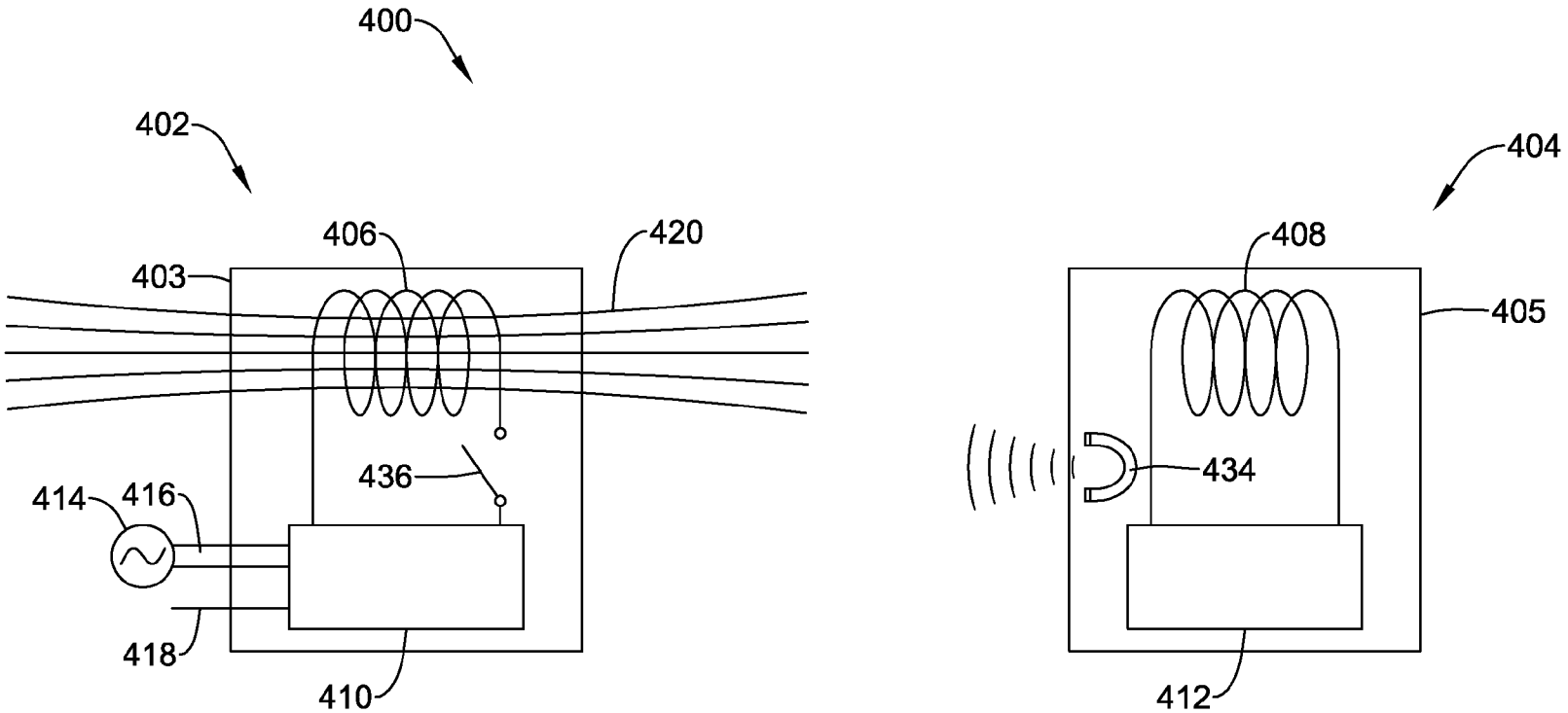
FIG. 4*b* is a schematic diagram of the illustrative non-contact switch of FIG. 4*a*, showing the first and second parts separated by more than a threshold distance.

Other arrangements of a magnet pair in a switch are contemplated. For example, FIGS. 4*a* and 4*b* are schematic diagrams of another illustrative non-contact switch 400. Like switch 300, the components of switch 400 may be structured and configured with features of switch 200 of FIGS. 2*a* and 2*b*, or any features described in other illustrative embodiments of switches of the present disclosure, to the extent that they are compatible with the implementation in switch 400 of a magnetic pair. The magnetic pair of switch 400 includes a magnet 434 and a magnet sensor 436. The magnetic pair may be configured to register a magnetic status of open or closed depending on the relative displacement and/or orientation of the magnet 434 and magnet sensor 436. In some illustrative embodiments, the magnetic pair is configured to register a magnetic status of closed or open, depending on whether a magnet distance between the magnet and magnet sensor is beyond a threshold magnet distance. If the magnet distance is beyond a threshold magnet distance, the magnetic pair may register a magnetic status of open, and if the magnet distance is within a threshold magnet distance, the magnetic pair may register a magnetic status of closed.

As with magnetic pair of switch 300, the magnetic pair of switch 400 of FIGS. 4*a* and 4*b* may be based upon any suitable magnetic technology, and magnetic sensor 436 may be any suitable magnetic sensor. In FIGS. 4*a* and 4*b*, magnetic sensor 436 is schematically illustrated as a magnetically-actuated switch that closes (conducts) when first part 402 and second part 404 of switch 400 are disposed within a threshold magnet distance (FIG. 4*a*), and opens (does not conduct) when the parts are separated by more than the threshold magnet distance (FIG. 4*b*). In FIGS. 4*a* and 4*b*, magnetic sensor/switch 436 is schematically illustrated as being electrically disposed between inductive power transmit coil 406 and WA interrogator 410. As such, magnetic sensor/switch 436 may allow (when closed) or prevent (when open) either or both of supplying power to the inductive power transmit coil 406, and providing an interrogation signal 422 from WA interrogator 410 to the coil for broadcast to the WA responder 412. In some illustrative embodiments, power from power supply 414 is not routed through the WA interrogator to the inductive power transmit coil 406, but the first part 402 of the switch may still be configured so that the power is supplied or not supplied to the transmit coil depending on the magnetic status and the state of magnetic sensor/switch 436. In some illustrative embodiments, a magnetic sensor/switch may not physically make or break an electrical connection between a coil/antenna and responder, but may provide a signal of magnetic status (closed or open), and other components of the first part may be configured to achieve the result of controlling transmission of power and/or signals to the coil/antenna. In some illustrative embodiments, a magnetically-actuated switch may be disposed between a power supply and a WA interrogator, such that the magnetically-actuated switch, when closed, allows power to be provided to the WA interrogator, and when open, does not allow power to be provided to the WA interrogator. Regardless of the particular implementation details, and in some instances, switch 400 may be configured so that it reports the status as closed only if both the WA status is registered as closed and the magnetic status is registered as closed. As with switch 300, as the positions of the first and second parts 402, 404 of switch 400 change with respect to each other, as would happen, for example, when the first and second parts move along with first and second members to which they are attached, the WA distance and magnet distance vary.

In some illustrative embodiments, a non-contact switch may be configured with any suitable combination of WA pair, magnetic pair, and/or inductive power transmission pair. Each of the WA pair, magnetic pair, and/or inductive power transmission pair may independently register a status of closed or open. The non-contact switch may be configured to register a closed status only if all pairs (WA pair, magnetic pair, and/or inductive power transmission pair) of the non-contact switch are registered as closed, or only if two or more pairs are registered as closed. The determination of whether all pairs (or two or more pairs) of the non-contact switch are registered as closed may be performed by any suitable component of the non-contact switch, such as a microprocessor or microcontroller of a WA transceiver. Alternately, the determination of whether all pairs (or two or more pairs) of the non-contact switch are registered as closed may be performed by any suitable external agent, such as an interlock system controller.

Figure 5A:
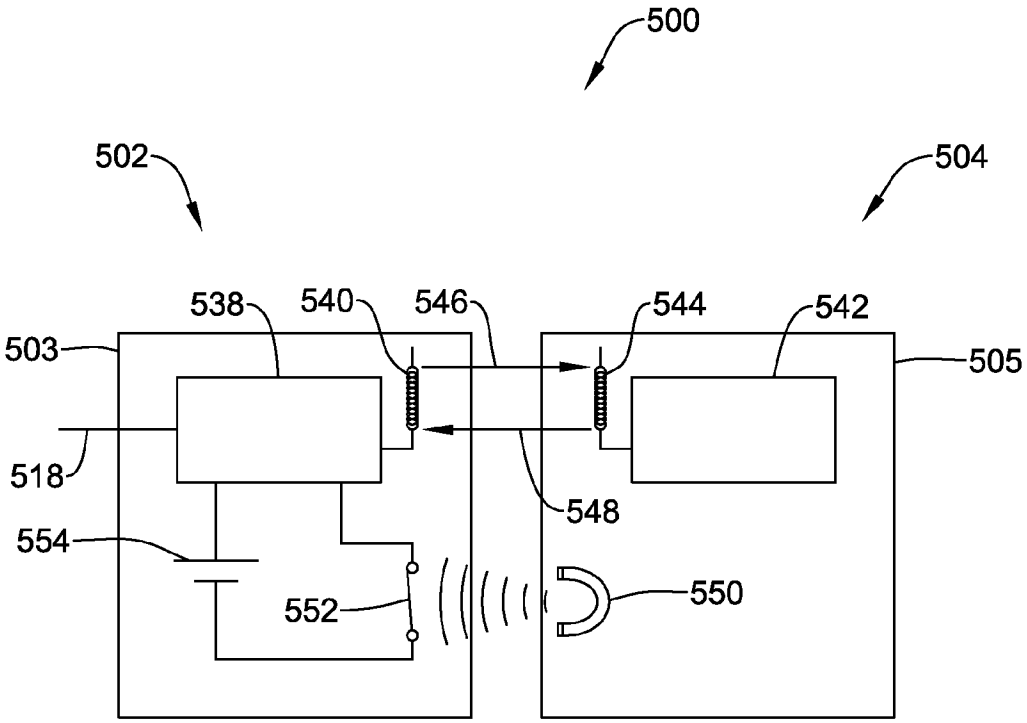
FIG. 5*a* is a schematic diagram of another illustrative non-contact switch having first and second parts in close proximity.
Figure 5B:
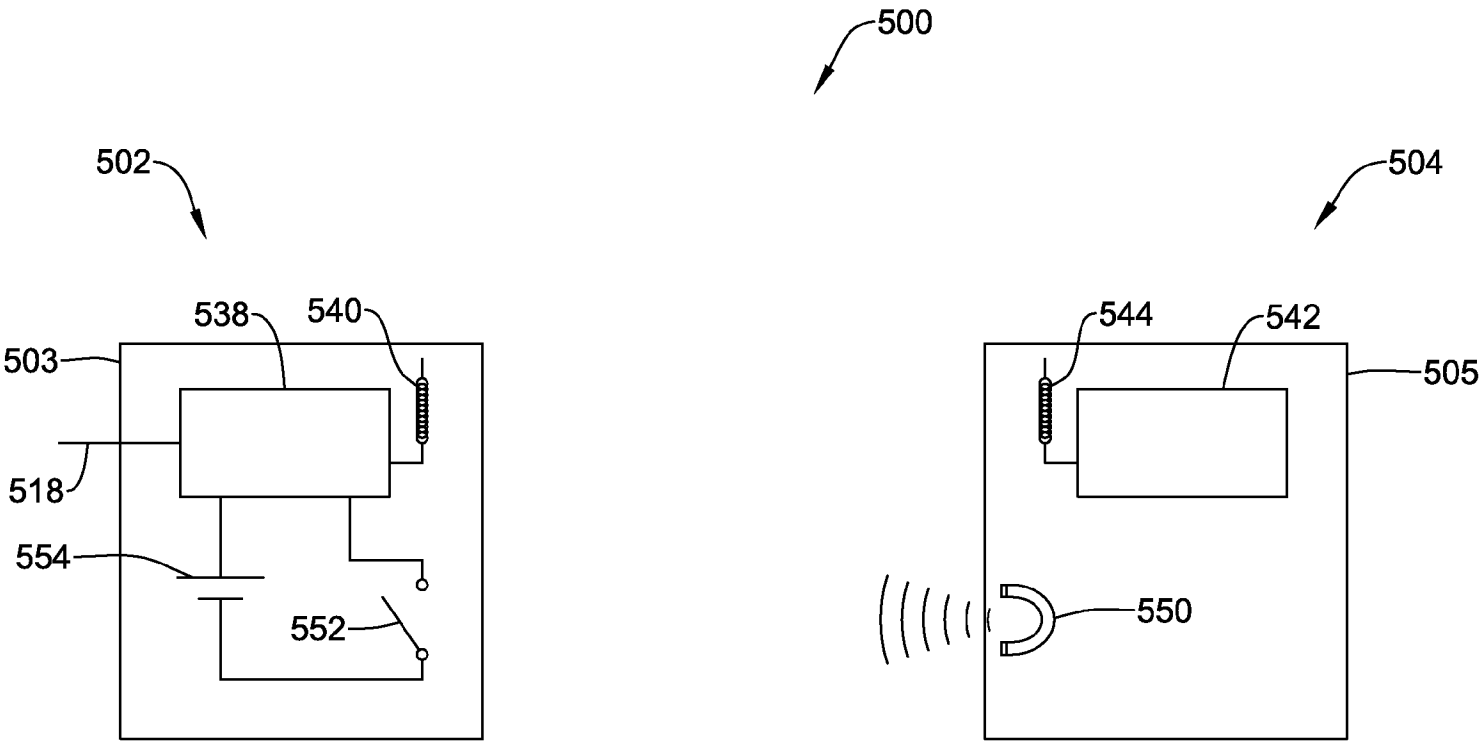
FIG. 5*b* is a schematic diagram of the illustrative non-contact switch of FIG. 5*a*, showing the first and second parts separated by more than a threshold distance.

FIGS. 5*a* and 5*b* are schematic diagrams of an illustrative non-contact switch 500, and in some instances may be used as either of switches 110 or 118 in the illustrative interlock system of FIG. 1 as one example. The components of switch 500 may be structured and configured with any features described in other illustrative embodiments of switches of the present disclosure, to the extent that they are compatible with the other disclosed features of switch 500.

Illustrative non-contact switch 500 may include a wireless authentication pair including a WA interrogator 538 which may have an antenna 540 and a WA responder 542 which may have an antenna 544. The wireless authentication pair of switch 500 may employ any suitable technologies and protocols as further disclosed elsewhere herein. In particular, the wireless authentication pair of switch 500 may incorporate Radio Frequency IDentification (RFID) technology and/or Surface Acoustic Wave (SAW) technology. WA responder 542 may be an RFID tag or a SAW tag, or an RFID tag incorporating SAW technology. WA interrogator 538 and WA responder 542 may employ antennas 540 and 544 when executing or attempting a wireless authentication. To perform a wireless authentication, WA interrogator 538 may broadcast an interrogation signal 546, schematically represented with an arrow directed toward WA responder 542. Upon receiving an interrogation signal 546 from the WA interrogator 538, WA responder 542 (which may be powered from any suitable source, including power carried by the interrogation signal 546) may reply with a response signal 548, schematically represented with an arrow directed toward the WA interrogator in FIG. 5*a*. Response signal 548 may be an authenticating response including an identification code such that WA interrogator 538 may determine whether the response signal matches a known identification code, and hence, matches an expected authenticating response. A WA interrogator 538 may be configured to register a WA status of closed only if such a successful authenticating match is made, and to register a WA status of open otherwise. After attempting a wireless authentication, the WA interrogator 538 may communicate an appropriate status of closed or open to an interlock system controller through a communication link, such as one using cable 518.

The illustrative non-contact switch 500 of FIGS. 5*a* and 5*b* may include a magnetic pair including a magnet 550 and a magnetic sensor 552. The magnetic pair may be configured to register a magnetic status of open or closed depending on the relative displacement and/or orientation of the magnet 550 and magnet sensor 552. In some illustrative embodiments, the magnetic pair is configured to register a magnetic status of closed or open, depending on whether a magnet distance between the magnet and magnet sensor is beyond a threshold magnet distance. If the magnet distance is beyond a threshold magnet distance, the magnetic pair may register a magnetic status of open, and if the magnet distance is within a threshold magnet distance, the magnetic pair may register a magnetic status of closed. The magnetic pair of FIGS. 5*a* and 5*b* may be based upon any suitable magnetic technology, and magnetic sensor 552 may be any suitable magnetic sensor. In FIGS. 5*a* and 5*b*, magnetic sensor 552 is schematically illustrated as a magnetically-actuated switch that closes (conducts) when first part 502 and second part 504 of switch 500 are disposed within a threshold magnet distance (FIG. 5*a*), and opens (does not conduct) when the parts are separated by more than the threshold magnet distance (FIG. 5*b*). In FIGS. 5*a* and 5*b*, magnetic sensor/switch 552 is schematically illustrated as being electrically disposed between a power supply 554 and WA interrogator 538. As such, magnetic sensor/switch 552 may allow (when closed) or prevent (when open) provision of power from power supply 554 to WA interrogator 538. When deprived of power, WA interrogator 538 may be unable to wireless interrogate WA responder 542. In some illustrative embodiments, a magnetic sensor/switch may not physically make or break an electrical connection between a power supply and a WA interrogator, but may provide a signal of magnetic status (closed or open), and the WA interrogator may then be configured to not attempt a wireless interrogation of a WA responder if receiving a signal indicating magnetic status of open. Regardless of the exact configuration, illustrative non-contact switch 500 may be configured to register a status of closed only if the magnetic pair registers a magnetic status of closed, and the WA pair registers a WA status of closed.

Figure 6:
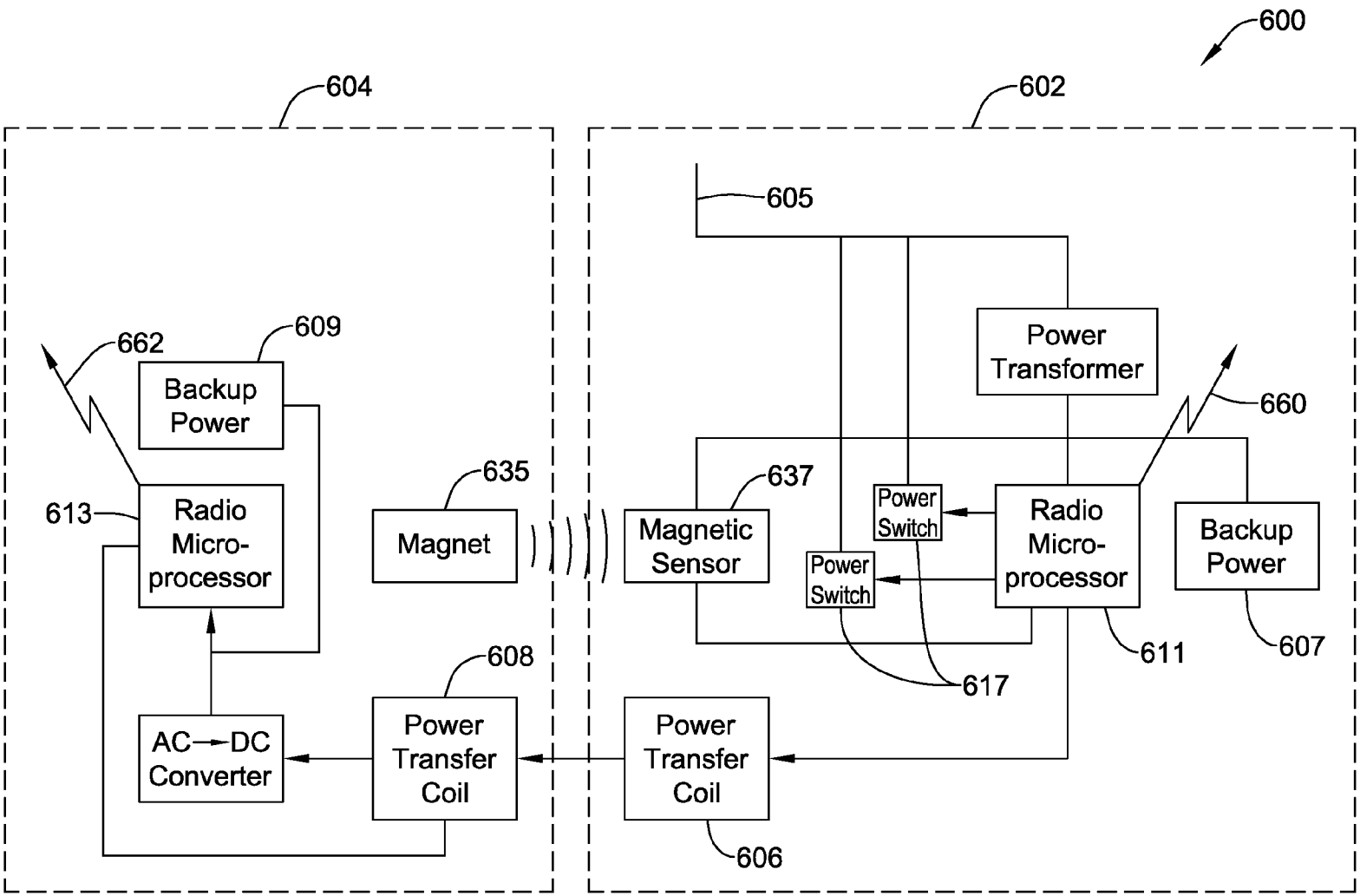
FIG. 6 is a schematic diagram of another illustrative non-contact switch.

FIG. 6 is a schematic diagram of another illustrative non-contact switch 600. The illustrative non-contact switch 600 includes a first part 602 and a second part 604. Switch 600 in some instances may be used as either of switches 110 or 118 in the illustrative interlock system of FIG. 1 as one example. The components of switch 600 may be structured and configured with features of other illustrative embodiments of switches of the present disclosure, to the extent that they are compatible. Likewise, the features of switch 600 may be incorporated into other embodiments of switches of the present disclosure, to the extent that they are compatible.

Non-contact switch 600 illustrates a number of features that may help increase switch reliability and redundancy. In some instances, power may be supplied to switch 600 via line 605 from, for example, an interlock system controller. Power may be transferred from the first part 602 to the second part 604 via power transfer coils 606, 608, respectively. As shown, both first and second parts 602, 604 may include backup power storage components 607, 609, which may be, for example, batteries or capacitors that may be charged from the nominal power supplies, and which may supply sufficient operational power to the components of the first and second parts for a period of time in case of insufficient power from the nominal power supplies. For the first part 602, the nominal power supply may be, for example, power delivered over line 605. For the second part 604, the nominal power supply may be, for example, power transferred to coil 608 from coil 606.

The illustrative non-contact switch 600 includes one or more power switches 617 that may be closed to indicate a status of closed to an interlock system controller. Power switches 617 may be controlled by, for example, microprocessor 611, which may close the switches based upon any suitable criteria. Suitable criteria may include, for example, whether the magnetic pair 635, 637 register a magnetic status of closed. Magnetic pair 635, 637 may employ any suitable magnetic technology, and may be reversed with respect to magnet 635 and magnetic sensor 637 placement on first and second parts 602, 604. Either or both microprocessors 611, 613 may participate in assessing the status of the magnetic pair. Likewise, either or both microprocessors 611, 613 may participate in assessing the transfer of power between coils 606, 608, which may be considered with regard to the open or closed status of the non-contact switch 600. Either or both microprocessors 611, 613 may communicate with each other and/or the interlock system controller, for example, to report on the status and/or health of any components of non-contact switch 600. Such communication may be performed via wired and/or wireless communication links 660, 662. In some cases, microprocessors 611, 613 may help form a WA pair. Alternatively, or in addition, the non-contact switch 600 may include a WA pair (e.g. a WA interrogator and a WA responder), similar to that described above.

Figure 7:
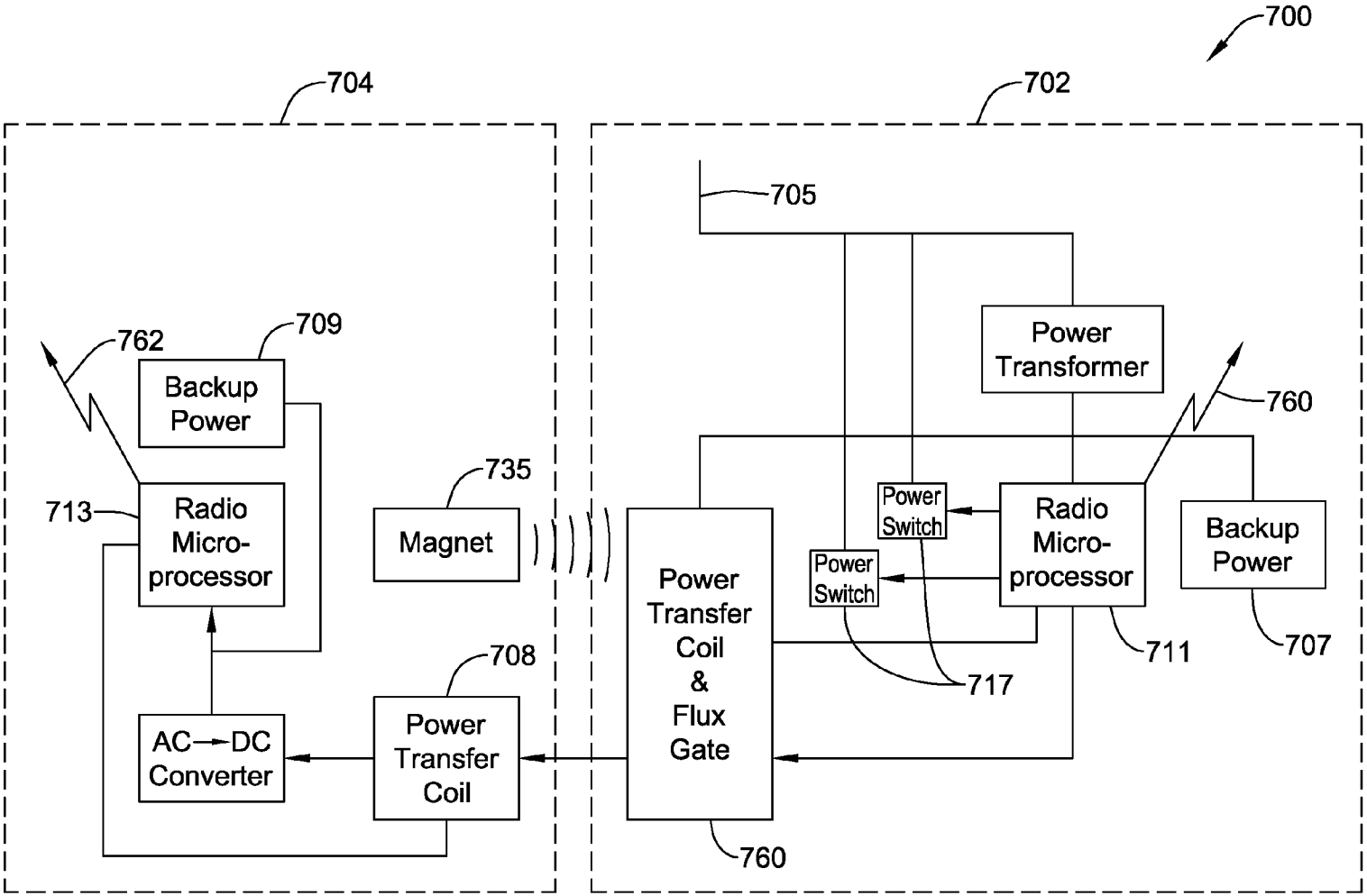
FIG. 7 is a schematic diagram of another illustrative non-contact switch.

FIG. 7 is a schematic diagram of another illustrative non-contact switch 700. The illustrative non-contact switch 700 has a first part 702 and a second part 704. Switch 700 is similar in several aspects to switch 600 of FIG. 6, and may be used similarly. Alternatively, or in addition, the non-contact switch 700 may include a WA pair (e.g. a WA interrogator and a WA responder), similar to that described above. In any event, the features of switch 700 may be incorporated into other embodiments of switches of the present disclosure, to the extent that they are compatible.

In the first part 702 of non-contact switch 700 of FIG. 7, a combined coil 760 may serve both as an inductive power transfer coil and as a coil for a flux gate. In an alternate arrangement, a combined coil may be provided for the second part 704, with a magnet and a power transfer coil correspondingly being provided in the first part 702. Using a combined coil, such as coil 760, may allow a reduced part count, lower cost, and/or may result in a simpler system architecture for non-contact switch 700. In some illustrative embodiments, non-contact switches may incorporate some, but not all, of the features discussed herein to reduce part counts and/or cost. For example, a lower cost option for a non-contact switch may include power wiring leading to a switch having a WA radio transceiver/microprocessor, where communication to an interlock system controller may be provided via radio transmission, potentially eliminating the need for hard-wired communication. The lower cost non-contact switch may or may not include inductive power transfer coils, depending on the circumstances.

In some illustrative embodiments, hardware requirements may be reduced by combining multiple second parts (each with a WA responder) to provide multiple switches that operate with a single first part (with a WA interrogator), and a single communication link to an interlock system controller. Unique identifying codes associated with the distinct second parts may make it possible for a single first part to serve multiple switches. Furthermore, two and/or three axis sensitive magnet sensors may be used, which may allow a single magnet sensor to be used in the first part, and multiple magnets in multiple second parts. Such an arrangement may be feasible, for example, with double doors closing onto a common center pillar. Alternatively, or in addition, the use of two and/or three axis sensitive magnet sensors may help compensate for variations in separation/alignment between magnet and sensor pairs caused by vibration and/or are built up over time as a consequence of vibration and/or other mechanical stresses (e.g. a sagging door).

The disclosure should not be considered limited to the particular examples described above. Various modifications, equivalent processes, as well as numerous structures to which the disclosure can be applicable will be readily apparent to those of skill in the art upon review of the instant specification.

What is claimed is:

1. A redundant non-contact switch for reporting a status as closed or open for a first member and second member that move relative to each other between an open state and a closed state, comprising:

a magnet attached to one of the first member and the second member;

a first inductive power transfer coil attached to the same one of the first member and the second member as the magnet;

a combined coil attached to the other of the first member and the second member, the combined coil configured as a second inductive power transfer coil paired with the first inductive power transfer coil, the combined coil further configured as a flux gate paired with the magnet, the magnet and the flux gate are configured as a magnetic pair that is registered as closed when the first member and the second member are in the closed state; and the redundant non-contact switch is configured to report the interlock status as closed only if the magnetic pair is registered as closed.

2. The redundant non-contact switch of claim 1, wherein the redundant non-contact switch is configured to report the interlock status as closed by closing at least one electronic switch.

3. The redundant non-contact switch of claim 1, further comprising:

a wireless authentication (WA) pair including:

a WA responder attached to one of the first member and the second member; and a WA interrogator attached to the other of the first member and the second member;

wherein the WA pair is registered as closed when:

the first member and the second member are in the closed state; and the WA responder and the WA interrogator successfully complete a WA authentication;

further wherein the redundant non-contact switch is configured to report the interlock status as closed only if the WA pair is registered as closed in addition to the magnetic pair being registered as closed.

4. The redundant non-contact switch of claim 3, wherein the combined coil is further configured as an antenna for whichever of the WA responder or WA interrogator is attached to the one of the first member or the second member to which the combined coil is attached.

5. The redundant non-contact switch of claim 3, further comprising at least one backup power supply configured to provide operational power to at least part of the WA pair in the event that a nominal power supply does not provide sufficient operational power to the at least part of the WA pair.

6. A redundant non-contact switch for reporting a status as closed or open for a first member and a second member that move relative to each other between an open state and a closed state, comprising:

a wireless authentication (WA) pair, including:

a WA responder attached to one of the first member and the second member;

a WA interrogator attached to the other of the first member and the second member;

the WA pair configured to register a WA status of closed or open, depending on a WA authentication between the WA responder and the WA interrogator;

a magnetic pair, including:

a magnet attached to one of the first member and the second member;

a non-mechanical magnet sensor attached to the other of the first member and the second member;

the magnetic pair configured to register a magnetic status of closed or open, depending on whether a displacement between the magnet and magnet sensor is within a pre-determined range; and the redundant non-contact switch configured to report the status as closed only if both the WA status is registered as closed and the magnetic status is registered as closed.

7. The redundant non-contact switch of claim 6, wherein the WA interrogator includes an inductive power transmit coil and the WA responder includes an inductive power receive coil, the WA responder further including a backup power supply, and wherein the WA responder requires operational power to perform the WA authentication, the operational power being provided from at least one of the inductive power receive coil and the backup power supply.

8. The redundant non-contact switch of claim 6, wherein the WA responder, WA interrogator, magnet, and non-mechanical magnet sensor are arranged on the first member and second member such that the displacement between the magnet and the non-mechanical magnet sensor, and a displacement between the WA interrogator and the WA responder vary as the first member and second member move between the open and closed states.

9. The redundant non-contact switch of claim 6, wherein the redundant non-contact switch is configured to report the interlock status as closed by closing at least one electronic switch.

10. The redundant non-contact switch of claim 6, wherein:

the WA interrogator and the non-mechanical magnet sensor are both attached to the same one of the first member or second member; and the WA responder and the magnet are both attached to the other one of the first member or second member.

11. The redundant non-contact switch of claim 6, wherein:

the WA interrogator and the magnet are both attached to the same one of the first member or second member; and the WA responder and the non-mechanical magnet sensor are both attached to the other one of the first member or second member.

12. The redundant non-contact switch of claim 6, wherein at least one of the WA responder and the WA interrogator is configured to communicate a measure related to performance of the redundant non-contact switch to an external device.

13. The redundant non-contact switch of claim 6, wherein the pre-determined range of displacement between the magnet and magnet sensor has a magnitude of at least about 10 mm.

14. A secure non-contact switch, comprising:

two or more of:

a wireless authentication (WA) pair including a WA responder and a WA interrogator, the WA pair configured to register a WA status of closed or open, the WA status depending on a WA authentication between the WA responder and the WA interrogator;

a magnetic pair including a magnet and a non-mechanical magnet sensor, the magnetic pair configured to register a magnetic status of closed or open, the magnetic status depending on a magnet displacement between the magnet and magnet sensor; and/or an inductive power transmission pair including an inductive power transmit coil and an inductive power receive coil, the inductive power transmission pair configured to register an inductive power transmission status of closed or open, the inductive power transmission status depending on relative positioning of the inductive power transmit and receive coils;

the secure non-contact switch configured to report a closed status only if at least two of the two or more of the WA pair, the magnetic pair, and/or the inductive power transmission pair are registered as closed.

15. The secure non-contact switch of claim 14, wherein the secure non-contact switch comprises all three of the WA pair, the magnetic pair, and the inductive power transmission pair, and further wherein the secure non-contact switch is configured to report a closed status only if all three pairs register as closed.

16. The secure non-contact switch of claim 14, wherein the secure non-contact switch comprises at least the WA pair and the inductive power transmission pair, and further wherein one of the WA responder and WA interrogator is configured to receive power from the inductive power receive coil, the secure non-contact switch further including a backup power supply for the one of the WA responder and WA interrogator configured to receive power from the inductive power receive coil, and wherein the one of the WA responder and WA interrogator configured to receive power from the inductive power receive coil requires operational power to perform the WA authentication, the operational power being provided from at least one of the inductive power receive coil and the backup power supply.

17. The secure non-contact switch of claim 16, wherein the one of the WA responder and WA interrogator configured to receive power from the inductive power receive coil is configured to recognize when insufficient operational power is received from the inductive power receive coil, and to report such to an external device.

18. The secure non-contact switch of claim 14, wherein the secure non-contact switch comprises the magnetic pair, further wherein the magnetic pair is configured to recognize a magnitude of magnet displacement consistent with a magnetic status of closed that is at least about 10 mm.

19. The secure non-contact switch of claim 14, wherein the secure non-contact switch comprises the WA pair, further wherein at least one of the WA responder and the WA interrogator is configured to communicate a measure related to performance of the secure non-contact switch to an external device.

20. The secure non-contact switch of claim 19, wherein both the WA responder and the WA interrogator are configured to communicate measures related to performance of the secure non-contact switch to the external device.

* * * * *